US011059657B2

(12) United States Patent
Frank

(10) Patent No.: US 11,059,657 B2
(45) Date of Patent: Jul. 13, 2021

(54) ANTI-EVAPORATION CAP COVER FOR TOWELETTE DISPENSER CONTAINER AND ASSEMBLY

(71) Applicant: Thomas R. Frank, Lake Geneva, WI (US)

(72) Inventor: Thomas R. Frank, Lake Geneva, WI (US)

(73) Assignee: SCHOENECK CONTAINERS, INC., New Berlin, WI (US)

( * ) Notice: Subject to any disclaimer, the term of this patent is extended or adjusted under 35 U.S.C. 154(b) by 0 days.

(21) Appl. No.: 16/859,462

(22) Filed: Apr. 27, 2020

(65) Prior Publication Data

US 2020/0255209 A1 Aug. 13, 2020

Related U.S. Application Data

(63) Continuation of application No. 15/939,834, filed on Mar. 29, 2018, now Pat. No. 10,676,271.

(60) Provisional application No. 62/479,927, filed on Mar. 31, 2017.

(51) Int. Cl.

| | |
|---|---|
| ***B65D 81/24*** | (2006.01) |
| ***B65D 83/08*** | (2006.01) |
| ***B65D 75/58*** | (2006.01) |
| ***A47K 10/38*** | (2006.01) |
| ***B65D 43/16*** | (2006.01) |

(52) U.S. Cl.

CPC ..... *B65D 83/0835* (2013.01); *A47K 10/3827* (2013.01); *B65D 43/169* (2013.01); *B65D 75/5805* (2013.01); *B65D 81/24* (2013.01); *B65D 2543/0062* (2013.01); *B65D 2543/0074* (2013.01); *B65D 2543/00092* (2013.01); *B65D 2543/0099* (2013.01); *B65D 2543/00296* (2013.01); *B65D 2543/00537* (2013.01); *B65D 2543/00685* (2013.01); *B65D 2543/00796* (2013.01); *B65D 2543/00972* (2013.01)

(58) Field of Classification Search

CPC ..... B65D 83/0805; B65D 83/0835; B65D 75/5805; A47K 10/3827; A47K 2010/3266

USPC ..... 206/409; 221/63, 307

See application file for complete search history.

(56) References Cited

U.S. PATENT DOCUMENTS

| | | | |
|---|---|---|---|
| 4,467,930 | A | 8/1984 | Schnell et al. |
| 4,892,220 | A | 1/1990 | Foos |
| 5,582,314 | A | 12/1996 | Quinn et al. |
| 5,788,064 | A | 8/1998 | Sacherer et al. |
| 5,950,848 | A | 9/1999 | Baudin |
| 6,092,690 | A | 7/2000 | Bitowft et al. |
| 6,112,951 | A | 9/2000 | Mueller |

(Continued)

FOREIGN PATENT DOCUMENTS

| | | |
|---|---|---|
| EP | 0911273 | 4/1999 |
| WO | 201618137 | 11/2016 |

*Primary Examiner* — King M Chu

(74) *Attorney, Agent, or Firm* — Davis & Kuelthau, S.C.; Joseph S. Heino; Erin E. Kaprelian

(57) ABSTRACT

An assembly comprises a container, a primary container cover, and a secondary flip up cover. The primary container cover comprises a two-shot injection molded component and includes an integrally-formed seal. The integrally-formed seal is designed to reduce or eliminate evaporation occurring between the container and the primary cover. The integrally-formed seal is further designed to reduce or eliminate evaporation occurring between the primary cover and the secondary flip up cover.

3 Claims, 6 Drawing Sheets

(56) References Cited

U.S. PATENT DOCUMENTS

| | | | | |
|---|---|---|---|---|
| 6,158,614 | A | 12/2000 | Haines et al. | |
| 6,474,493 | B1 | 11/2002 | Lacout | |
| 6,592,004 | B2 | 7/2003 | Huang et al. | |
| 6,729,498 | B2 | 5/2004 | Yelton et al. | |
| 6,766,919 | B2 | 7/2004 | Huang et al. | |
| 6,986,434 | B1 | 1/2006 | Getsy et al. | |
| 7,370,653 | B2 | 5/2008 | Payne | |
| 7,597,213 | B2 | 10/2009 | McDonald | |
| 7,614,519 | B2 | 11/2009 | Krauth et al. | |
| 7,887,731 | B2 | 2/2011 | Schmeisser et al. | |
| 7,997,444 | B2 * | 8/2011 | Martins | B65D 83/0805 221/63 |
| 8,317,061 | B2 * | 11/2012 | Vignot | A47K 10/42 221/45 |
| 8,404,166 | B2 | 3/2013 | Cocchi et al. | |
| 8,608,001 | B2 | 12/2013 | Stoneberg et al. | |
| 8,789,540 | B2 | 7/2014 | Lee | |
| 9,027,754 | B2 | 5/2015 | Berger et al. | |
| 2004/0035817 | A1 | 2/2004 | Lagler | |
| 2005/0087543 | A1 * | 4/2005 | Smith | B65D 43/0231 221/63 |
| 2005/0184082 | A1 * | 8/2005 | Smith | B65D 47/0838 221/65 |
| 2009/0101619 | A1 | 4/2009 | Cano-Pey | |

* cited by examiner

ANTI-EVAPORATION CAP COVER FOR TOWELETTE DISPENSER CONTAINER AND ASSEMBLY

This application is a continuation of U.S. patent application Ser. No. 15/939,834 filed Mar. 29, 2018 and claims the benefit and priority of U.S. Provisional Patent Application No. 62/479,927 filed Mar. 31, 2017.

FIELD OF THE INVENTION

The present invention relates generally to product containers of the type that are used for storing products in a container and for dispensing products from within the container. More specifically, the preferred embodiment of the present invention relates to containers of the type that are dispensers for towelettes, which are also commonly called "wet wipes" when the towelettes are pre-moistened with a liquid of the type that is used for any number of personal, household, automotive or other purposes or applications. Even more specifically, the preferred embodiment of the present invention relates to an improved towelette dispenser cap cover that substantially reduces or eliminates the evaporation of liquid retained in the moistened towelettes, thereby extending the useful life of the product, the product being an assembly comprising the dispenser, its contents and the improved cap cover. It is to be understood, however, that the anti-evaporation cap cover of the present invention can be used with any container where the intended or desired use is to preclude evaporation of moisture from moistened items, materials or substances stored in the container in any number of product applications.

BACKGROUND OF THE INVENTION

Pre-moistened and disposable towelettes impregnated with a cleaning solution, a disinfectant solution or other surfactant are well known in the marketplace for sanitizing one's hands and other surfaces and are often called "wet wipes" or simply "wipes." However, any number of other personal, household and automotive purposes and applications are also well known for such products and the present invention is not limited to any specific purpose, use or application. For example, it can be drawn to dispensers for hand sanitizing wipes just as well as automotive detailing wipes. It is also to be noted that the terms "wipes", "wet wipes" and "towelettes" are used interchangeably within this disclosure and are not limiting in any way. Those terms are construed herein to mean "a premoistened paper or fiber towel."

Wet wipe dispensing products are desirable because they are portable and well known to provide a user with the convenience of opening the dispenser, pulling one or more wet wipes from the dispenser and then closing the dispenser for later use and anticipated preservation of the remaining wipes within the dispenser. Inside the container, the wipes are typically wound into a continuous roll of partially perforated and liquid-saturated or moistened wipes, with the wipes being pulled and unwound from the center of the roll. The wipes are most often pulled through an opening disposed in the top of the dispenser. The "pull through" opening comprises structure that provides sufficient resistance on dispensed wipes such that the leading wipe tears away from the next following wipe and enables full separation between adjacent or sequential wipes. This opening then exposes only a small portion of the next following wipe, such wipe portion being large enough to be grasped and pulled by the user, but small enough to avoid exposure of that wipe to substantial evaporation of liquid from a significant portion of the wipe. This process can be repeated until all wipes in the container have been dispensed. Such wipes may also be layered or grouped in some other fashion where the wipes are not wound into a roll.

It is also well known that the dispenser containers themselves can be formed in virtually any shape including, without limitation, round cylinders, oval containers, square boxes, etc. and the present invention is not limited in this regard. Irrespective of the shape of the dispenser container, one common problem persists with all such dispensers in applications where the wet wipes are not frequently or continuously used. That problem, as alluded to above, is the evaporation of the moisture that is captured within the wipes, which evaporation happens over time, thereby drying out the wipes and making them unsuitable for their intended use. Such "moisture evaporation sites" typically include two primary structural interfaces that are inherent in this type of wipe dispensing product.

The first moisture evaporation site is at the interface where a primary cover is attached to a main container body, which cover may be screwed onto or snapped onto the main container body. This effectively "captures" and holds the wipes within the container, but not necessarily in an airtight fashion. The second site is at the interface where a typically smaller secondary flip up cover "snap" fits to the container cover, the flip up cover being hingedly secured to the primary container cover. This is not necessarily an airtight seal either and can lead to liquid evaporation where the flip up secondary cover is not closed completely or even when the cover is closed completely as intended simply because a small gap may present itself at this interface.

Therefore, in the experience of the inventor, there is need for an improved wipes dispenser cover that reduces the evaporation rate of liquid held within the moistened wipes and thereby extends the useful life of the dispenser and its contents. As alluded to at the outset, however, it is to be understood that the anti-evaporation cap cover of the present invention can be used with any container where the intended or desired use is to prevent evaporation of moisture from moistened items, materials or substances stored in the container in any number of product applications.

SUMMARY OF THE INVENTION

In accordance with the foregoing, the invention provides an improved assembly that comprises a container, a primary container cover and a secondary flip up cover. The primary container cover is a two-shot injection molded component that includes an integrally-formed seal. The integrally-formed seal is configured to eliminate the aforementioned evaporation site between the container and the primary cover as well as the evaporation site between the primary cover and the secondary flip up cover.

The foregoing and other features of the improved cap cover for use with a towelette dispenser container or other similarly used container will be apparent from the detailed description that follows.

DETAILED DESCRIPTION OF THE INVENTION

Figure 1:
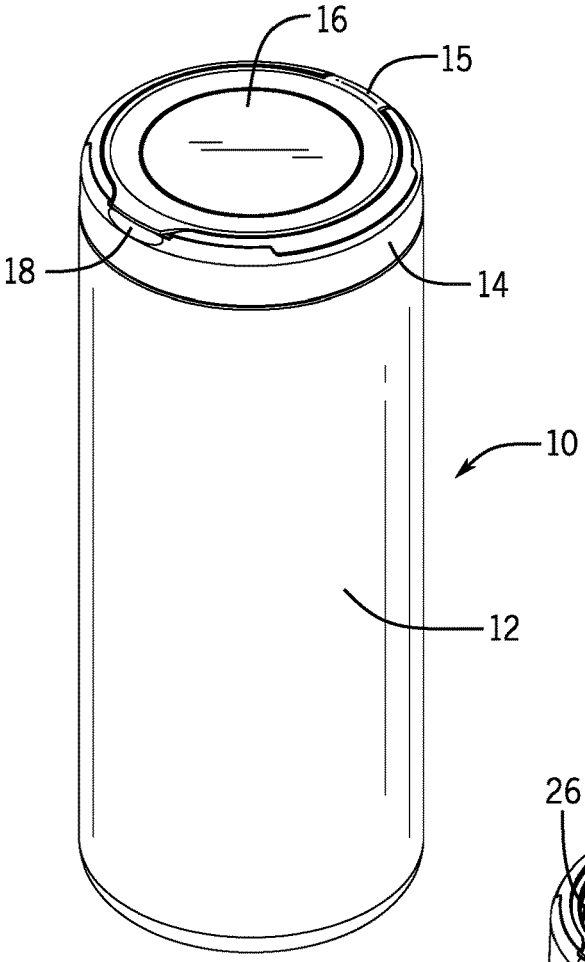
FIG. 1 is a top and side perspective view of the towelette dispenser with the improved cap cover as described herein and showing the flip up cover in the "closed" position.
Figure 2:
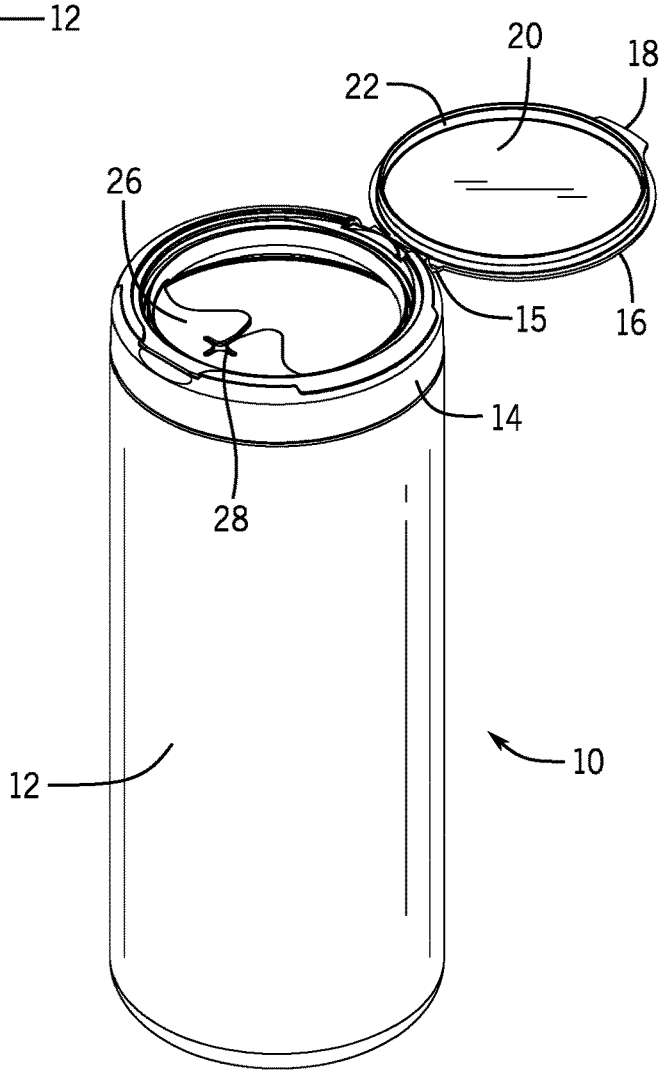
FIG. 2 is the same view as that shown in FIG. 1 but showing the flip up cover in the "open" position.
Figure 3:
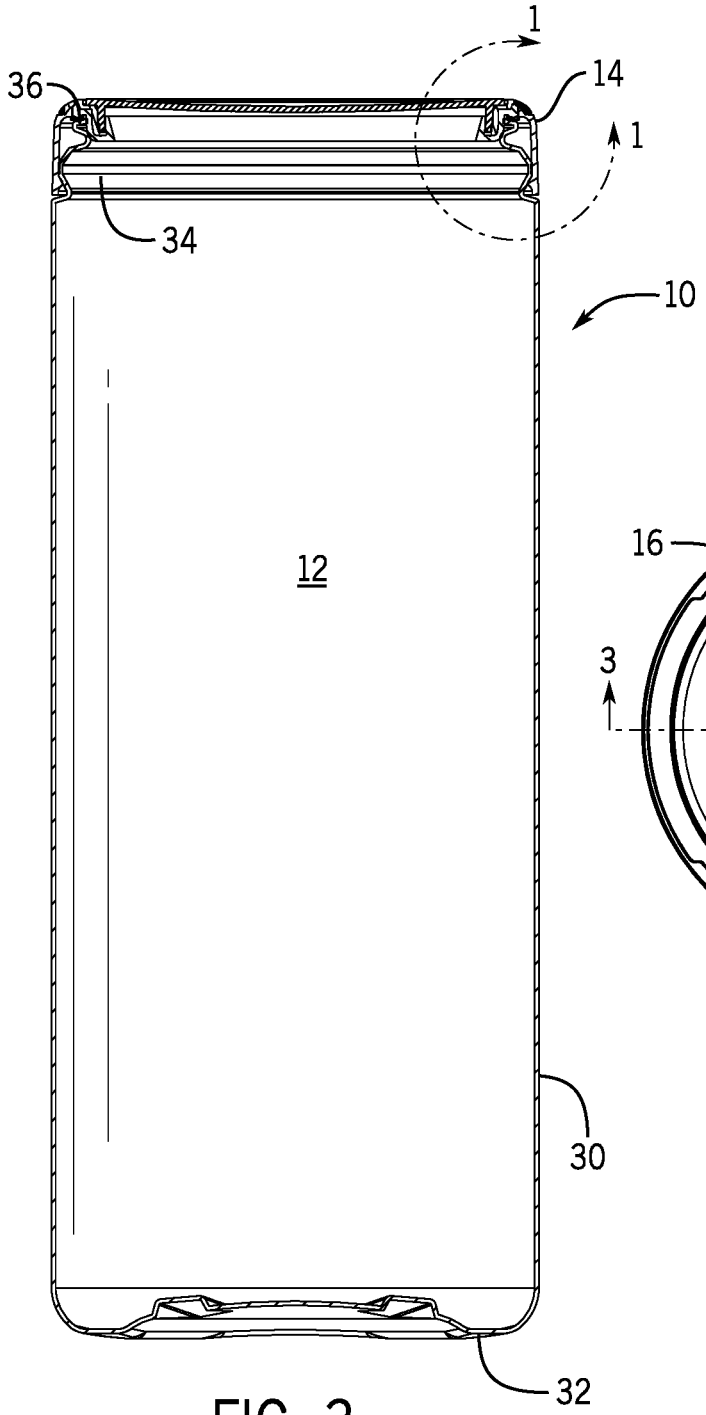
FIG. 3 is a front cross-sectioned view of the towelette dispenser shown in FIG. 1.
Figure 4:
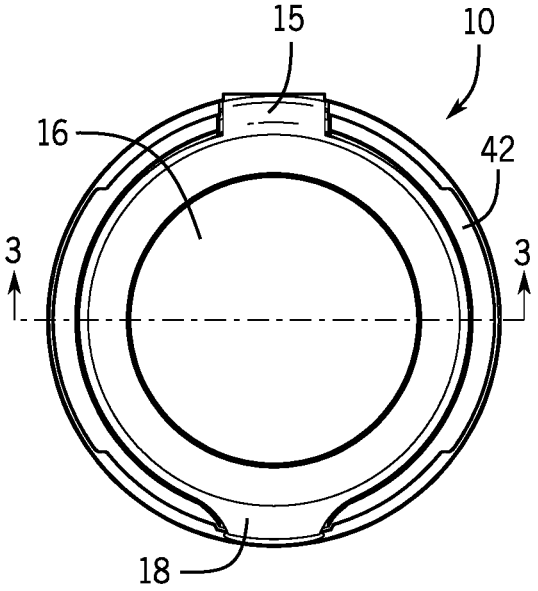
FIG. 4 is a top plan view of the towelette dispenser shown in FIG. 1.

Referring now to the drawings in detail, wherein like-numbered elements refer to like elements throughout, FIG. 1 illustrates the dispenser assembly, generally identified 10. The assembly 10 comprises a dispenser body, generally identified 12, and a cap cover, generally identified 14. As is also shown in FIGS. 2-4, the cap cover 14 further comprises a flip up lid or cover, generally identified 16. FIGS. 1 and 4, for example, show the assembly 10 where the flip up cover 16 is in a fully "closed" position and engaged with the cap cover 14. In FIG. 4, it will be appreciated that the cap cover 14 and the flip up cover 16 are attached via a hinge structure 15, which is typically an integrally-formed hinge 15 disposed between the cap cover 14 and the flip up cover 16. FIG. 2 shows the assembly 10 where the flip up cover 16 is in a fully "open" position and hingedly rotated away, and disengaged, from the cap cover 14, but not completely separated because of the interposed hinge structure 15.

FIG. 3 shows a cross-section of the dispenser body 12 within which the wipes (not shown) are retained. One benefit of the dispenser body 12 is that it comprises an integral one-piece structure, such that it can be molded as a single piece of a suitable plastic material, having a circumferential and continuous side wall 30, an integral floor 32 and an upper opening 34, the upper opening 34 further comprising a lip 36. Disposed at the upper opening 34 is means for securing the cap cover 14 to the dispenser body 12 at its upper opening 34 and lip 36. The securement means is configured to be structure that is complementary to corresponding structure in the cap cover 14. That is, the securement means can be complementary threads formed in both the dispenser body 12 and in the cap cover 14. Alternatively, a "snap on" securement, as shown in this particular embodiment, is the preferred embodiment. See FIGS. 5 and 6.

Figure 8:
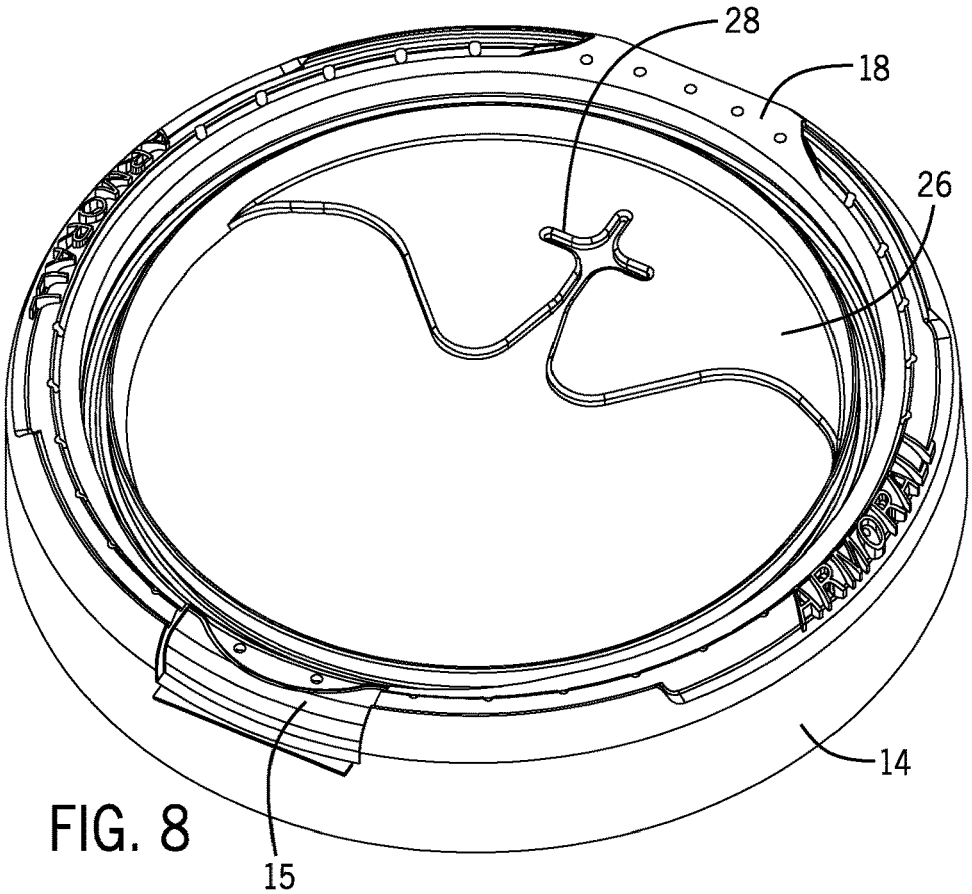
FIG. 8 is a top and side perspective view of the cap cover as molded but disassociated from the sealing structure.

In the open position shown in FIG. 2 and in the view shown in FIG. 8, it will be appreciated that the cap cover 14 comprises a generally pliable towelette pull-through structure 26 having a feed-tear notch 28 defined in it. With this structure, the dispenser body 12 is capable of receiving and dispensing a supply of interconnected towelettes (again, not shown) with adjacent towelettes being separated via perforations formed between them and by the pressure applied to them via the pull-through structure 26 and its associated feed-tear notch 28. However, it is also to be understood that the precise configuration of the pull-through structure 26 and its associated feed-tear notch 28 is not a limitation of the present invention. All that is required is that the feed-tear notch 28 of the pull-through structure 26 be configured such that it applies enough tension between adjacent towelettes whereby a first towelette can be pulled from the dispenser body 12 through the notch 28 and is then torn away from the next-to-be-used towelette along the towelette perforations. This results in the next-to-be-used towelette protruding slightly from the notch 28 but enough that a user can easily grasp it with his or her fingers and remove that towelette in like fashion.

In some examples, pull-through structure 26 with feed-tear notch 28 may be absent. In such examples, the cap cover 14 and flip up cover 16, along with the structural sealing point interfaces (discussed further with respect to FIGS. 2 and 4), may remain present. As a result, the cap cover 14 and flip up cover 16 may sealingly engage with the dispenser body 12. The pull-through structure 26 may not be included due to the nature of the towelettes; for example, a thicker towelette may not be conducive to use with the pull-through structure 26. Of course, examples are not so limited, and the pull-through structure 26 and feed-tear notch 28 may be absent for any reason where the assembly 10 contains a product other than towlettes. In other examples, the product use or application may be for other moistened items, materials, substances or other goods of the type that may be stored in the container in any number of product applications.

Figure 5:
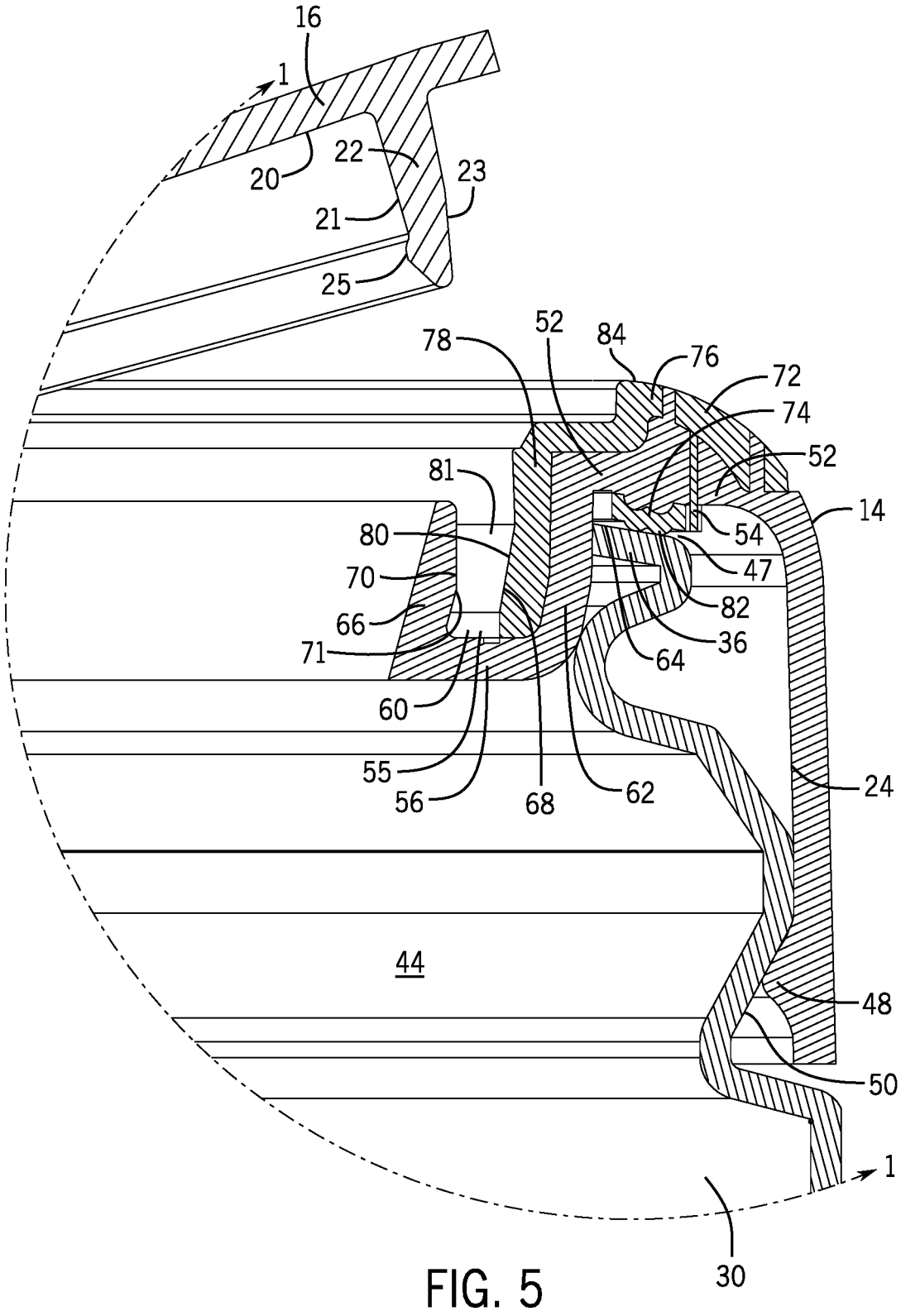
FIG. 5 is an enlarged cross-sectioned elevation view taken along line 1-1 of FIG. 3 detailing the sealing point interfaces in the cap cover, the flip up cover and the dispenser, but showing the flip up cover in an open position.
Figure 6:
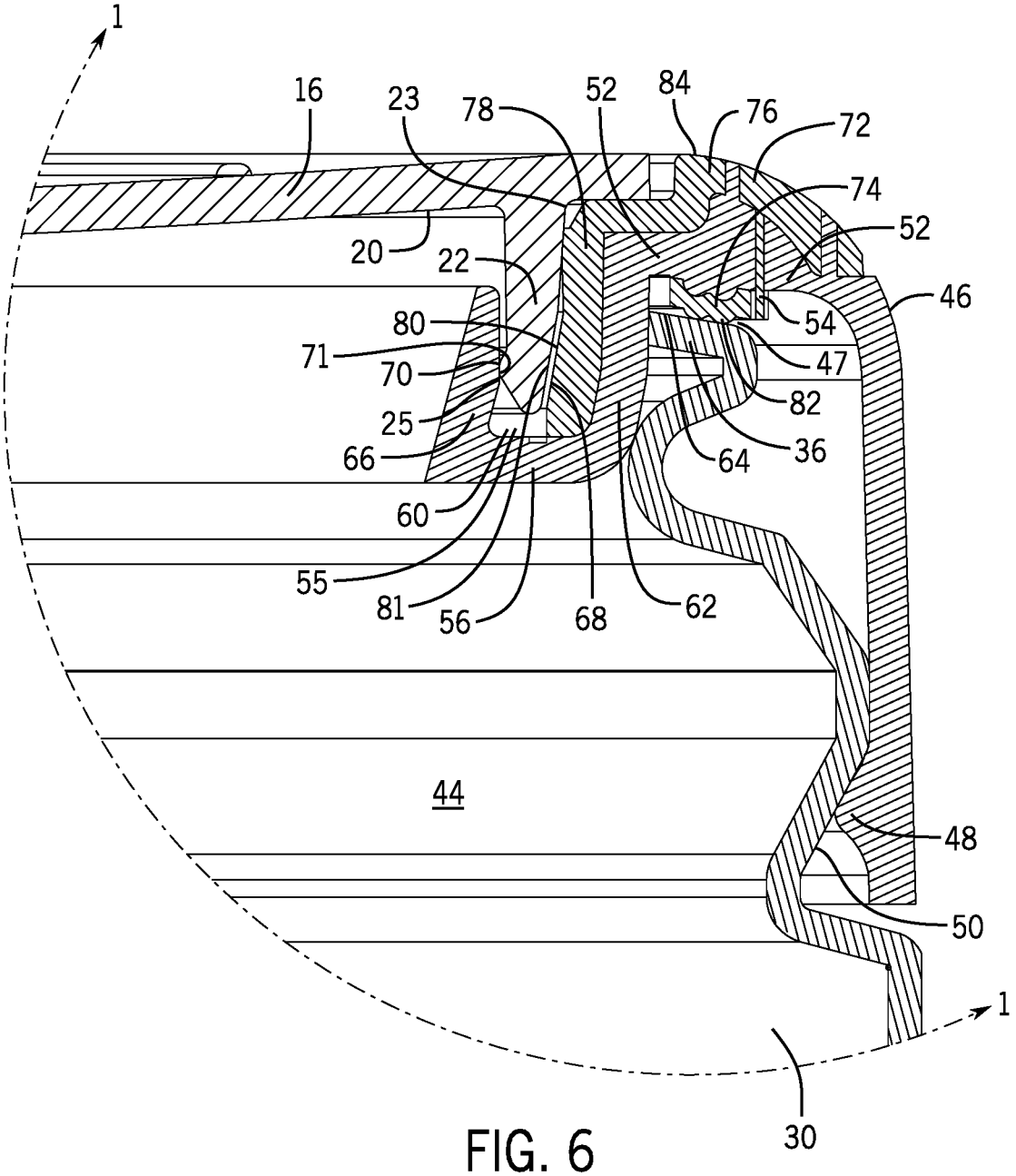
FIG. 6 is a view similar to FIG. 5 but showing the flip up cover in a closed position.

FIGS. 2 and 4 further show that the flip up cover 16 comprises a hand or finger grab member 18 for opening the flip up cover 16. It also comprises a bottom surface 20 and a cylindrically-shaped and continuous circumferential ridge 22 that extends downwardly from that bottom surface 20, when the cover 16 is in its closed position (but shown extending upwardly in its inverted open position shown in FIG. 2). As shown in FIG. 5, it will be seen that the downwardly extending circumferential ridge 22 comprises an inwardly-facing surface 21 and an outwardly-facing surface 23. Further, the bottom or distal portion of the downwardly extending circumferential ridge 22 comprises an inwardly extending circumferential ridge 25 disposed on the inwardly-facing surface 21 of the downwardly extending circumferential ridge 22. The inwardly extending circumferential ridge 25 may engage with the U-shaped recess 60 when the flip up cover 16 is in the closed position. See FIG. 6.

The two structural sealing point interfaces and evaporation sites, one such site being between the cap cover 14 and dispenser body 12, generally identified 47, and the other such site being between the flip up cover 16 and the cap cover 14, generally identified 55, are best illustrated in FIG. 5 as well. More specifically, an upper portion 44 of the dispenser body side wall 30 is shown. At this upper portion 44 is a circumferential outer recess 50. At the uppermost portion of the dispenser body 12 is the lip 36, as described above. Also shown is a portion of the cap cover 14 which comprises an inner surface 24 defined by a sidewall having an inward protrusion 48. This inward protrusion 48 complements the recess 50 of the dispenser body 12 in that it allows a "snap fit" of the cap cover 14 to the dispenser body 12. Again, the attachment or securement means can be snap fit, threaded screw on or other suitable securement means.

The inner surface 24 of the cap cover 14 comprises a circumferential lip 52. Again, see FIG. 5. Lip 52 includes an injection flow port 54. Injection flow port 54 serves to receive a material as part of an injection molding process, such that the components of cap cover 14, such as lip 52, are formed. Extending inwardly lip 52 is a portion of a seat for the flip up cover 16 which portion comprises a substantially U-shaped structure. This U-shaped structure is comprised of a substantially vertical outer wall 62, a substantially horizontal bottom floor 56 and a substantially vertical inner wall 66. A U-shaped recess 60 is formed between those three structures.

Continuing with reference to FIG. 5, a circumferential seal 72 is molded, preferably via a two shot molding process, as part of the cap cover 14. The seal 72 is integrally formed with two sealing structures that are disposed under the cap cover 14. Specifically, a first circumferential seal member 74 extends downwardly into the gap 47, as described above, and a second circumferential seal member 78 extends downwardly into the U-shaped recess 60. The seal members 74, 78 are connected via a substantially horizontal and continuous rim 76. As shown in FIG. 5, the lowermost portion 82 of the first seal member 74 extends slightly beyond the bottommost portion of the gap 54 such that this portion 82 of the first seal member 74 engages the upper surface 64 of lip 36 of the dispenser body side wall 30. This creates a seal between the cap cover 14 and the dispenser body 12 at this evaporation site. Further, the second seal member 78 comprises an inner surface 80 that engages an outer facing surface 81 of the downwardly extending circumferential ridge 22 of the flip up cover 16. Also, the ridge 22 comprises an inwardly extending circumferential ridge 25 such that, when the flip up cover 16 is lowered for closing, the inwardly extending circumferential ridge 25 is urged against and into the seal member 78 by an outward taper 70 of the inner wall 66 of the U-shaped structure of the cap cover 16. That is, inwardly extending circumferential ridge 25 engages with a protrusion 71 to keep cap cover 16 in place, while further urging outer surface 23 against an inner surface 68 of seal member 78 to create a seal. Lastly, the rim 76 of the seal 72 comprises a top surface 84 that engages the bottom surface 20 of the flip up cover 16 to provide yet another seal surface. Together, this creates a seal between the cap cover 14 and the flip up cover 16 at this evaporation site.

It is also to be noted that the seal 72 is formed of a material having a relatively low durometer in comparison to the material of the cap cover 14 and the flip up cover 1 such that the seal members 74, 78 are compressible at the evaporation sites mentioned above so as to seal such sites and prevent fluid evaporation from the towelettes. In the process of molding the seal 72 with the cap cover 14, a plurality of apertures (not shown) are disposed within the cap cover 14 to allow the flow of seal material between the outer and inner portions of the cap cover 14.

Figure 7:
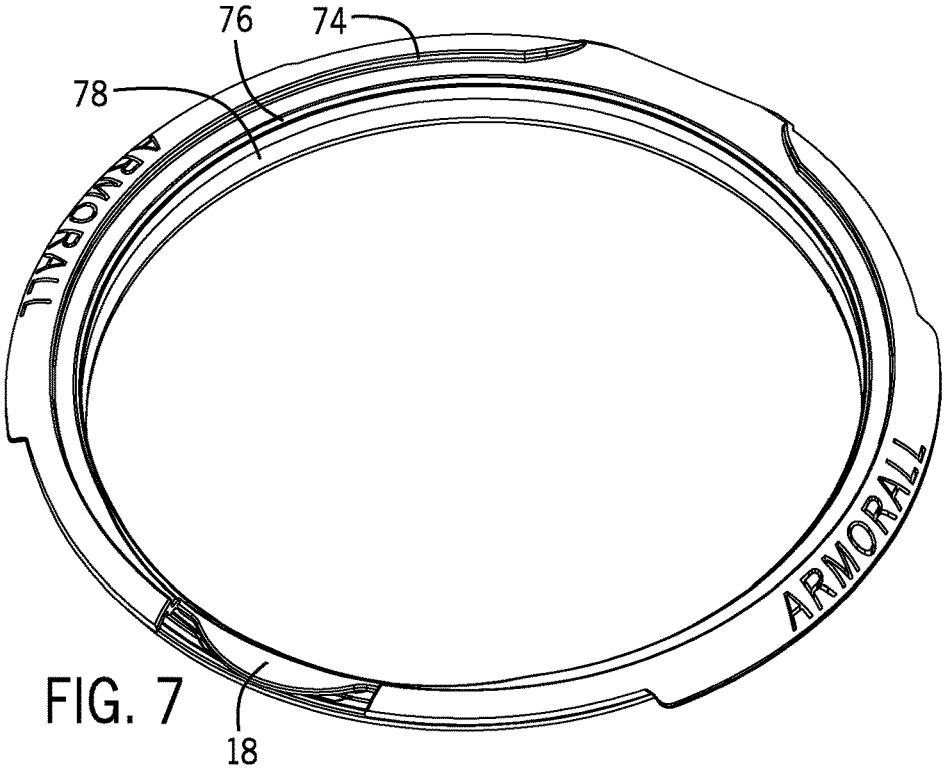
FIG. 7 is a top and side perspective view of the sealing structure as molded but disassociated from the cap cover.

FIG. 7 is a top and side perspective view of the sealing structure as molded but disassociated from the cap cover. As previously discussed, the sealing structure may be molded using a two-shot injection molding process. The sealing structure may include a first seal member 74 and a second seal member 78. The first seal member 74 may be connected to the second seal member 78 by a substantially horizontal and circumferential rim 76. As described previously, the first seal member 74 may engage a lip of a dispenser body (e.g. lip 36, shown in FIG. 5) and the second seal member 78 may engage with a protrusion of the dispenser body (e.g. protrusion 71, shown in FIG. 5).

Figure 9:
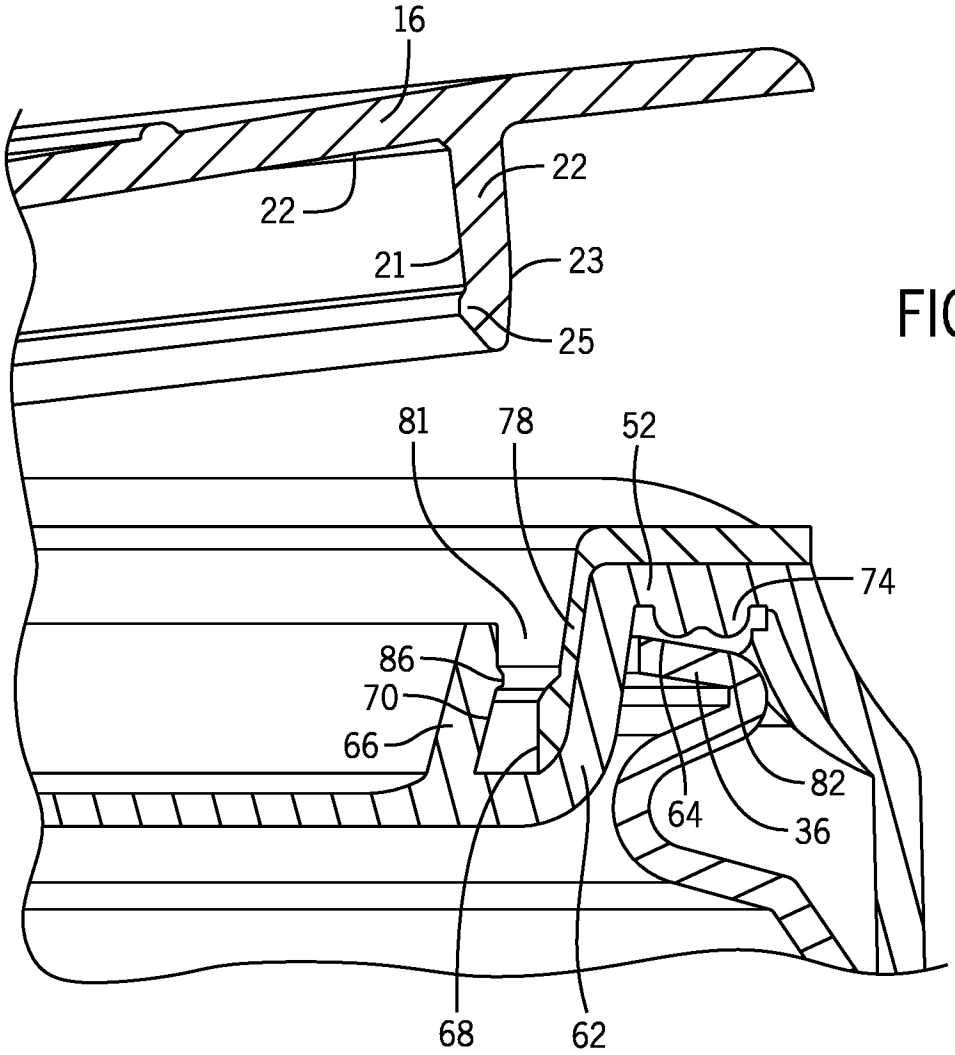
FIG. 9 is a cross-sectioned side elevation view detailing an additional embodiment of the cap cover and flip up cover.

FIG. 9 is a cross-sectioned side elevation view detailing an additional embodiment of the cap cover and flip up cover. Flip up cover 16, shown extended upwardly in its inverted open position, includes a downwardly extending circumferential ridge 22. The downwardly extending circumferential ridge 22 further comprises an inwardly-facing surface 21 and an outwardly-facing surface 23. Disposed on a bottom portion of the downwardly extending circumferential ridge 22 of the cover 16 is an inwardly extending circumferential ridge 25.

FIG. 9 further shows the first circumferential seal member 74 and second circumferential seal member 78, described previously with respect to FIG. 5. As previously described, a lowermost portion 82 of first seal member 74 extends to engage with an upper surface 64 of lip 36.

The second seal member 78 comprises a portion of a seat for a flip up cover, previously described with respect to FIG. 5. Included within the seat for the flip up cover may be a snap-fit interference point 86. Snap-fit interference point 86 may comprise an inwardly-extending protrusion that may engage with the inwardly extending circumferential ridge 25 located on flip up cover 16. In some examples, when flip up cover 16 is in the closed position, the inwardly extending circumferential ridge 25 may be located below snap-fit interference point 86. In such examples, the inwardly extending circumferential ridge 25 may be urged past the snap-fit interference point 86 when the flip up cover 16 is closed, such that flip up cover 16 is held in place with respect to the remainder of the dispenser body and cap cover (not shown in FIG. 9).

In view of the foregoing, it will be apparent that the present invention provides an improved assembly that comprises a container, a primary container cover and a secondary flip up cover. The primary container cover is a two-shot injection molded component that includes an integrally-formed seal. The integrally-formed seal is configured to eliminate the evaporation site between the container and the primary cover as well as the evaporation site between the primary cover and the secondary flip up cover.

The details of the invention having been disclosed in accordance with the foregoing, I claim:

1. An anti-evaporation assembly comprising:

a dispenser body having an opening and a lip about the opening;

a cap cover coupled to the dispenser body at the opening, the cap cover being a unitary structure comprising a seal, a flip up cover and a flexible hinge;

wherein the hinge connects the flip up cover to the cap cover such that the flip up cover can be folded over onto and coupled to the cap cover n a closed position;

wherein a gap between the cap cover and the dispenser body lip creates a first moisture evaporation point;

wherein a gap between the flip up cover and the cap cover creates a second moisture evaporation point;

wherein the first evaporation point is sealed via a first portion of the seal;

wherein the second evaporation point is sealed via a second portion of the seal;

wherein the first portion of the seal of the cap cover and the second portion of the seal of the cap cover form a unitary structure; and wherein:

the cap cover further comprises an inverted U-shaped structure; and the flip up cover comprises a bottom portion, a circumferential ridge extending downwardly from the bottom portion and having a distal portion together with an inwardly extending circumferential ridge at the distal portion, the downwardly extending circumferential ridge being disposed within the inverted U-shaped structure when the flip up cover and the cap cover are in the closed position.

2. The anti-evaporation assembly of claim 1 wherein the first portion of the seal is disposed within the gap between the cap cover and the lip of the dispenser body.

3. The anti-evaporation assembly of claim 1 wherein the second portion of the seal is disposed within the U-shaped structure.

* * * * *